US005812917A

United States Patent [19]

Iwata et al.

[11] Patent Number: 5,812,917

[45] Date of Patent: Sep. 22, 1998

[54] DEVELOPING APPARATUS

[75] Inventors: Naoki Iwata; Koji Suzuki, both of Saitama-ken, Japan

[73] Assignee: Ricoh Co., Ltd., Tokyo, Japan

[21] Appl. No.: 884,552

[22] Filed: Jun. 27, 1997

[30] Foreign Application Priority Data

Jun. 28, 1996 [JP] Japan ..... 8-188552

[51] Int. Cl.[6] ..... G03G 15/08

[52] U.S. Cl. ..... 399/281; 399/272; 399/285

[58] Field of Search ..... 399/281, 272, 399/258, 260, 265, 279, 285

[56] References Cited

U.S. PATENT DOCUMENTS

| | | | |
|---|---|---|---|
| 5,172,169 | 12/1992 | Takashima et al. . | |
| 5,239,344 | 8/1993 | Enoki et al. . | |
| 5,241,357 | 8/1993 | Iwata . | |
| 5,286,918 | 2/1994 | Iwata et al. . | |
| 5,311,263 | 5/1994 | Suzuki et al. . | |
| 5,315,061 | 5/1994 | Suzuki et al. . | |
| 5,339,141 | 8/1994 | Suzuki et al. . | |
| 5,424,814 | 6/1995 | Suzuki et al. . | |
| 5,451,713 | 9/1995 | Suzuki et al. . | |
| 5,467,175 | 11/1995 | Takagaki et al. . | |
| 5,502,552 | 3/1996 | Iwata et al. . | |
| 5,541,029 | 7/1996 | Iwata et al. . | |
| 5,617,190 | 4/1997 | Takenaka et al. | 399/159 |
| 5,708,942 | 1/1998 | Sugiyama et al. | 399/282 |

FOREIGN PATENT DOCUMENTS

| | | | |
|---|---|---|---|
| 2850997 | 5/1979 | Germany | 355/253 |

*Primary Examiner*—R. L. Moses
*Attorney, Agent, or Firm*—Oblon, Spivak, McClelland, Maier & Neustadt, P.C.

[57] ABSTRACT

A developing apparatus forms multiple toner layer and stably obtains predetermined toner charging amount and toner layer thickness, and further uniformly supplies the toner onto the toner carrying roller along its entire length. In the developing apparatus, a brush-like toner supplying roller having brush fibers and a second toner supplying roller are disposed at a predetermined interval and respectively brought into contact with a developing roller. The brush-like roller is first brought into contact with the developing roller after passing through the developing area on a photosensitive body opposing thereto, and the brush-like roller rotates in an inverse rotational direction to that of the developing roller at the contact position. The second roller is brought into contact with the developing roller after passing through the contact position with the brush-like roller, and rotates in a same rotational direction as that of the developing roller at the contact position.

15 Claims, 9 Drawing Sheets

DEVELOPING APPARATUS

BACKGROUND OF THE INVENTION

1. Field of the Invention

The present invention relates to a developing apparatus, in particular a developing apparatus employed in the process of image forming by use of electrophotographic non-magnetic, one-component developer for an electrophotographic copying machine such as PPC (Plain Paper Copy), PPF, LBP, etc.

2. Description of the Related Art

The conventional non-magnetic, one-component developing method is explained hereinafter, referring to FIG. 8 showing the conventional non-magnetic one-component developing apparatus. Non-charged toner 42 is accommodated in a hopper 40 which employs non-magnetic one-component developer and is agitated by an agitator 44. It is thereafter transported onto a toner supplying roller 46 employed as a developer supplying roller. The toner supplying roller 46 is brought into contact with the developing roller 48 and rotates in a rotational direction the same as or inverse to that of the developing roller 48. Thereby, the toner 42 is frictionally charged.

The toner 42 thus charged is attached to the surface of the developing roller 48 and thereafter is made uniform by a resilient restricting blade (thin layer forming blade) 50. Consequently, a toner layer (not shown in FIG. 8) of adequate thickness is formed on the developing roller 48. In a developing area where the developing roller 48 and a photosensitive body 52 employed as a latent image carrier oppose each other, the toner 42 is transferred from the toner layer on the developing roller 48 to the photosensitive body 52. The electrostatic latent image formed on the photosensitive body 52 can thus be made visible by use of the toner 42.

The optimum attaching amount and charging amount of the toner 42 in a non-magnetic one-component developing apparatus is described hereinafter. For instance, in the prior art shown in Japanese Laid-open Patent Publication Nos. 60-229057/1985 and 61-42672/1986, the amount of toner attaching onto the developing roller is 0.2~0.5 mg/cm$^2$, which is less than the 0.5~0.7 mg/cm$^2$ required on the transfer paper and the 0.6~1.0 mg/cm$^2$ required on the photosensitive body. For this reason, the rotational speed of the developing roller is increased to 2 to 4 times the rotational speed of the photosensitive body, and thereby the toner shortage can be eliminated.

However, when the developing operation is performed with such speed ratio, a so-called "toner rear-edge deviation" phenomenon occurs. To state more concretely, the density at the rear edge portion of the image tends to become high when a large black portion is developed. The above matter existed in the conventional black-and-white copying machine. However, in a color copying machine, the above-mentioned toner rear-edge deviation may become an important problem. Namely, when such phenomenon occurs, since the color image is viewed through the toner, there occurs a phenomenon of color difference.

In order to suppress the occurrence of such phenomenon, it is necessary to perform the developing operation with the rotational speed of the developing roller made approximately equal to that of the photosensitive body. For this reason, toner of at least 0.8 mg/cm$^2$ should be supplied onto the developing roller during equal-speed developing in the caseofcontacttypedevelopingwithhighdevelopingefficiency, while toner of an amount not less than 1.0 mg/cm$^2$ should be supplied in the case of non-contact type developing with low developing efficiency. For the purpose of obtaining such an attaching amount of toner, it is necessary to pile up the toner in multiple layers.

There has been proposed a developing apparatus to satisfy such a requirement in Japanese Laid-open Patent Publication No. 4-127177/1992. There, an electric charge is selectively held on the surface of the developing roller, and thereby a large number of microscopic (minute) closed electric fields (micro-fields) are formed near the surface of the developing roller, and a large amount of toner is attached to the surface of the developing roller by the action of the microscopic closed electric fields. For this purpose, minute dielectric portions regularly or irregularly distributed and grounded conductive portions are mixedly exposed on the surface of the developing roller. In such a structure, the toner supplying roller rotates in contact with the developing roller and a frictional electric charge is generated on the dielectric portion of the developing roller surface by friction between the toner supplying roller and the toner. Thereby, a large number of the small closed electric fields are created. Consequently, multiple toner layers can be held on the developing roller by the attraction of the very small closed electric fields.

However, even when employing the developing apparatus providing multiple toner layers, the following problems have arisen. Namely, as shown in FIG. 9 which is a partial enlargement of the toner supplying portion in the developing apparatus of FIG. 8, when the toner supplying roller 46 is rotated in contact with the developing roller 48 with their contacting surfaces moving in opposite directions, the toner 42 in the hopper scooped up by the agitator rides on the rotating toner supplying roller 46 and is transported in a direction shown by the blank arrow in FIG. 9. Thereafter, the toner 42 is attached to the developing roller 48 without passing through the contact position between the toner supplying roller 46 and the developing roller 48, and is transported to the resilient restriction blade 50. Consequently, the toner layer having insufficient frictional electric charge is unfavorably formed on the developing roller 48.

Furthermore, as shown in FIG. 10, which is also a partial enlargement of the toner supplying portion of the developing apparatus of FIG. 8, when the toner supplying roller 46 is rotated in contact with the developing roller 48 with their contacting surfaces moving in the same direction, toner 42 in the hopper scooped up by the agitator is transported in another direction shown by blank arrows in FIG. 10, passes along the lower side of the toner supplying roller 46, and thereafter is supplied to the contact position with the developing roller 48. Consequently, even though the uniformity of the charging state of the toner attached to the developing roller 48 may be improved, there further arises a necessity of installing a sealing mechanism 54 for damming up the toner 42 transported to the lower portion of the developing roller 48. As a result, the developing apparatus becomes complicated.

Furthermore, after the toner 42 on the developing roller 48 is consumed by performing developing, the amount of toner supplied onto the developing roller 48 may become insufficient when supplying toner only one time. Therefore, it is impossible to obtain a sufficient amount of toner charge and toner layer thickness. Only when the toner supplying roller 46 passes the toner through the toner supplying portion several times can the amount of toner charge and layer thickness be made sufficient. Consequently, the density shortage may occur at the rear end portion of an image having a large area.

SUMMARY OF THE INVENTION

The present invention was made in consideration of the above-mentioned problems.

It is an object of the present invention to provide a developing apparatus for forming multiple toner layers wherein the thickness of toner layer does not vary in accordance with the presence or absence of toner consumption in the developing process.

It is another object of the present invention to provide a developing apparatus capable of stably obtaining a predetermined amount of toner charge and toner layer thickness by supplying the toner one time.

It is still another object of the present invention to provide a developing apparatus capable of preferably supplying the toner without any unevenness on the entire surface in the longitudinal direction of the toner carrying roller.

It is still another object of the present invention to provide a developing apparatus capable of further enhancing the effect of erasing the development of ghost image on the toner carrying roller and reducing the time-elapsing variation of the image.

It is still another object of the present invention to solve all of the problems mentioned above.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
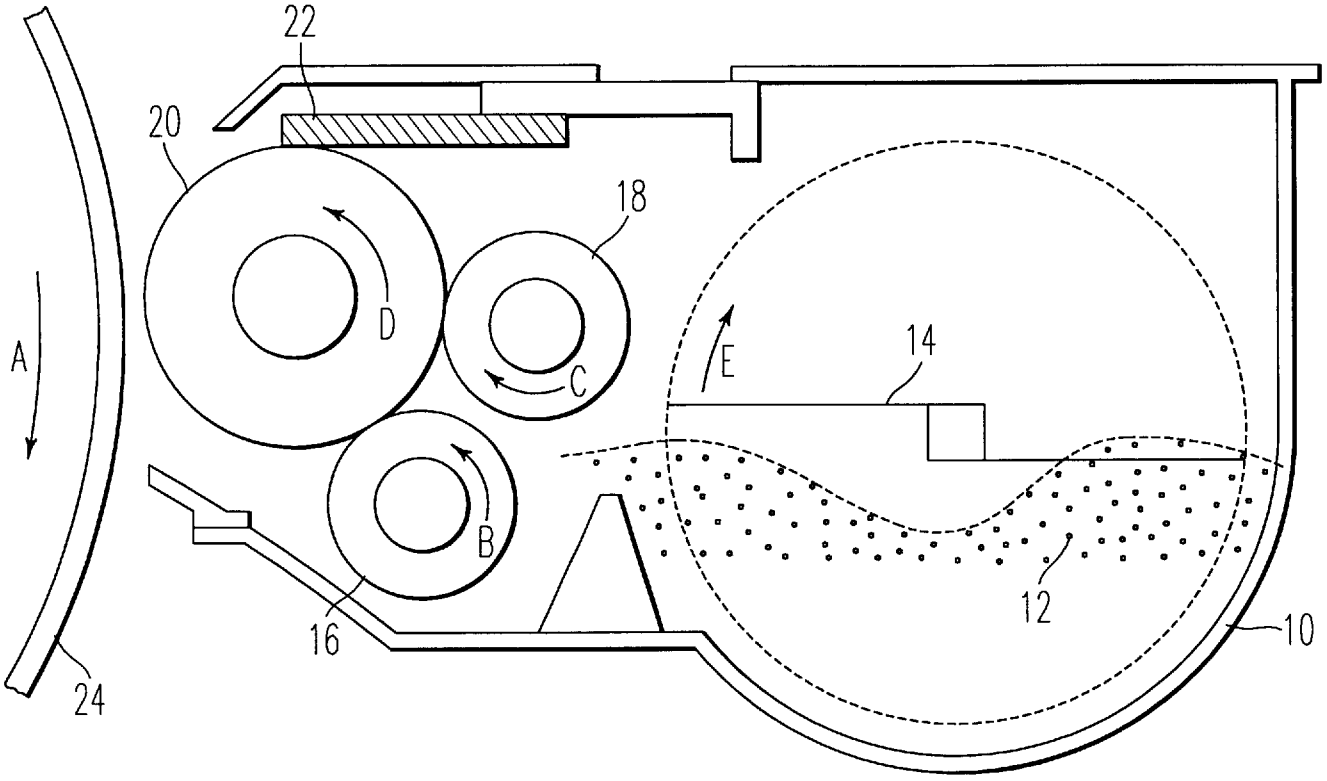
FIG. 1 is an outlined cross-sectional view for explaining the developing apparatus according to the present invention.
Figure 2:
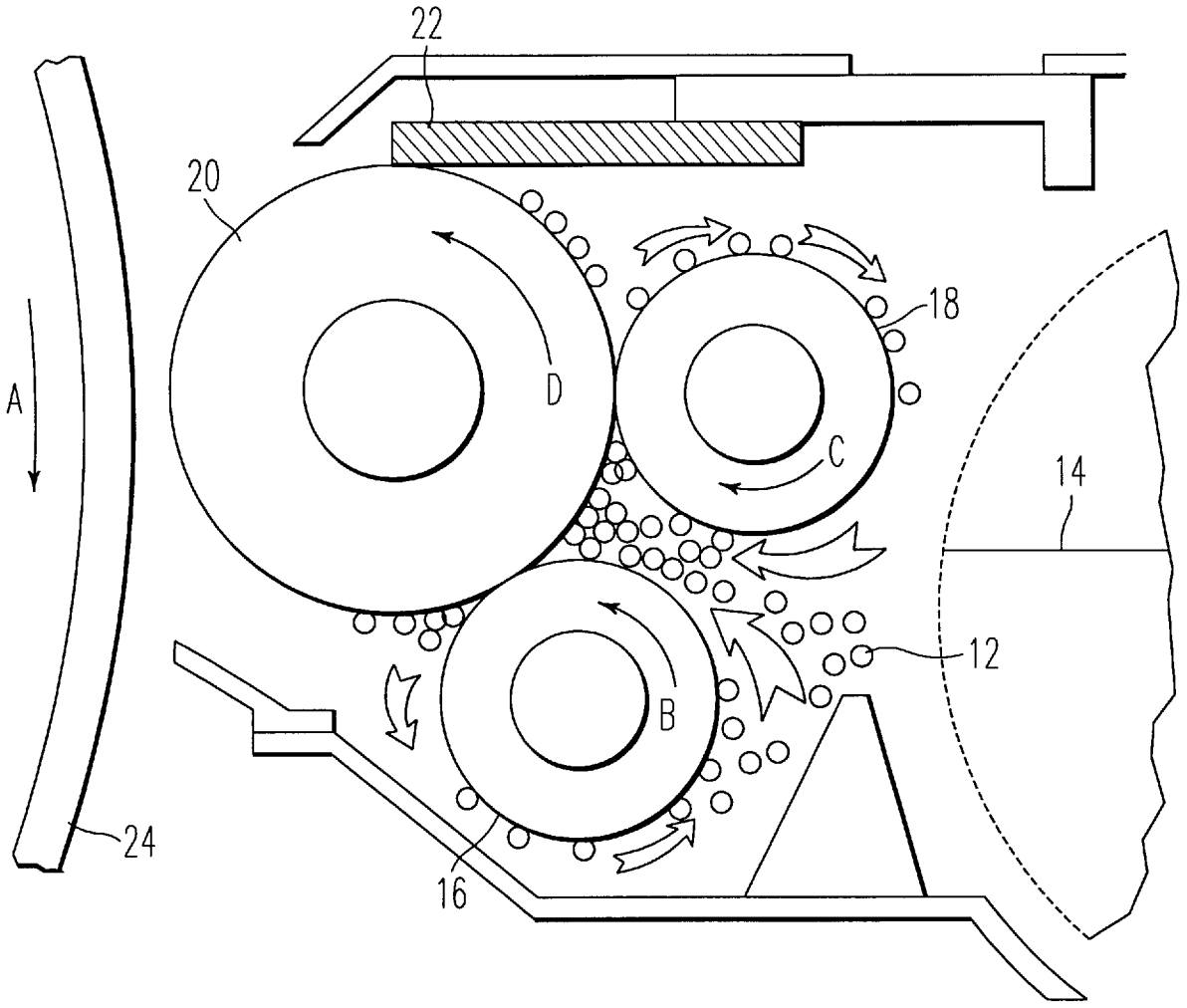
FIG. 2 is a partially enlarged view illustrating the toner supplying section in the developing apparatus shown in FIG. 1.

A developing apparatus according to the present invention is described hereinafter, referring to FIG. 1 and FIG. 2. FIG. 1 is an outlined cross-sectional view for explaining the developing apparatus of the present invention. FIG. 2 is a partially enlarged view showing the toner supplying section thereof.

Uncharged toner 12 employed as non-magnetic one-component developing agent (developer) annexed with supplementary additive agent is contained in a hopper 10 of the developing apparatus as occasion demands. The toner 12 is agitated by a rotating agitator 14 in a rotational direction shown by an arrow E in FIG. 1. A first toner supplying roller 16 functioning as a first developer supplying roller 16 and a second toner supplying roller 18 functioning as a second developer supplying roller are installed one above the other at a predetermined distance, and adjacent to a hopper containing the uncharged toner 12. Furthermore, a developing roller 20 functioning as a developer carrying roller is positioned so as to be respectively brought into contact with the first and second toner supplying rollers 16 and 18, and a resilient restriction blade 22 as a resilient restriction member is positioned so as to be brought into surface contact with the developing roller 20. Moreover, a photosensitive body 24 as a latent image carrier is opposed to the developing roller 20.

A specified portion of the developing roller 20 passes through the developing area opposed to the photosensitive body 24. Thereafter, the first toner supplying roller 16 is first brought into contact with the above-mentioned specified portion of the developing roller 20. As shown by an arrow B in FIGS. 1 and 2, the first toner supplying roller 16 rotates in a rotational direction inverse to that D of the developing roller 20 at the contact position therebetween.

On the other hand, the second toner supplying roller 18 is brought into contact with the developing roller 20 after the developing roller 20 passes the contact position with the first toner supplying roller 16. As shown by an arrow C in FIGS. 1 and 2, the second toner supplying roller 18 rotates in the same rotational direction as direction D of the developing roller 20 at the contact position therebetween. In other words, the first toner supplying roller 16 is located at the upstream side of the toner layer forming process, while the second toner supplying roller 18 is located at the downstream side of the toner layer forming process.

Consequently, by the action of the rotation of the first toner supplying roller 16, the direction of which is inverse to that of the developing roller 20 at the contact position between the first toner supplying roller 16 and the developing roller 20, the toner 12 remaining on the developing roller 20 after performing a developing operation is scraped off by the first toner supplying roller 16, and thereby the development of the ghost image is removed. Furthermore, the first toner supplying roller 16 performs the function of sending back the toner 12 on the lower portion of the first toner supplying roller 16 to the side of the hopper 10.

Furthermore, by the rotations of the first and second toner supplying rollers 16 and 18, the non-charged toner 12 transported and agitated by the agitator 14 is further transported primarily to an area between the first toner supplying roller 16 and the second toner supplying roller 18. For this reason, there is no fear that the toner 12 is attached onto the developing roller 20 and transported to the resilient restriction blade 22 without passing through the contact position between the second toner supplying roller 18 and the developing roller 20, and there is no fear that the toner 12 passes through the lower side of the first toner supplying roller 16 and is accumulated under the roller 16. Further, the toner 12 transported to the area between the first and second toner supplying rollers 16 and 18 is effectively supplied onto the developing roller 20.

The second toner supplying roller 18 transports the non-charged toner 12 transported to the space between the first toner supplying roller 16 and the second toner supplying roller 18 onto the developing roller 20 in cooperation with the first toner supplying roller 16, and by the rotation thereof in a rotational direction the same as that of the developing roller 20 at the contact position between the second toner supplying roller 18 and the developing roller 20, frictional charging is performed and the amount of attaching toner is properly restricted. Further, the non-charged toner 12 getting into the space under the blade 22 is sent back into the hopper.

Furthermore, the resilient restriction blade 22 is brought into direct surface contact with the developing roller 20 from the trailing direction against the rotation of the developing roller 20. Thereby, the resilient restriction blade 22 uniformizes the thickness of the toner layer on the developing roller 20 at the contact position between the second toner supplying roller 18 and the developing roller 20. The toner of the toner layer having the thickness thus uniformized on the developing roller 20 is transferred to the photosensitive body 24 at the developing area where the developing roller 20 and the photosensitive body 24 oppose each other, and thereby the latent image formed on the surface of the photosensitive body 24 can be made visible.

As mentioned heretofore, in the developing apparatus according to the present invention, due to rotation of the first and second toner supplying rollers 16 and 18, non-charged toner 12 of a constant amount is transported from the hopper to the area between the first toner supplying roller 16 and the second toner supplying roller 18. Therefore, there is no fear that the toner 12 is accumulated, and one can uniformly supply toner onto the developing roller 20.

Furthermore, in another developing apparatus according to the present invention, a brush-like member, for instance a brush fiber assembly, is formed on the surface of the first toner supplying roller. In this embodiment the tip end portions of the brush fibers assembly are brought into contact with the developing roller. In such situation, since the first toner supplying roller is the brush-like toner supplying roller, the functional effect of the developing apparatus according to the present invention such as the removal of the developed ghost image on the developing roller by use of the first toner supplying roller, the stable transportation of the non-charged toner to the space between the first toner supplying roller and the second toner supplying roller by the action of the rotations of the first and second toner supplying rollers, etc., can be more effectively accomplished.

Moreover, when the toner pressure of the non-charged toner transported to the space between the first toner supplying roller and the second toner supplying roller and accumulated therebetween is raised to a level higher than a certain value, the toner falls from the spaces between the brush fibers on the surface of the first toner supplying roller, and thereby the toner pressure of the accumulated non-charged toner is always kept constant.

For this reason, it may become possible to always keep constant the amount of the toner directed to the blade section after passing through the contact position between the second toner supplying roller and the developing roller. Furthermore, it may become possible to prevent the occurrence of problems such as the blocking phenomenon in which excessive toner is jammed in the space between the first toner supplying roller and the second toner supplying roller and so the toner does not flow. Consequently, the toner in the developing apparatus always circulates properly and uniform toner supplying pressure can be created in the longitudinal direction of the developing roller. Therefore, it may become possible to stably form the attached toner layer.

Furthermore, in still another embodiment the present invention, the tip end portion of the brush-like member, for instance the brush fiber assembly formed on the surface of the first toner supplying roller, is also brought into contact with the second toner supplying roller. Since the tip end portion of the brush fibers on the surface of the first toner supplying roller is brought into contact with the developing roller, and is also brought into contact with the second toner supplying roller, even though the charged toner scraped off from the developing roller by the action of the contact with the developing roller is attached to the brush fibers, the attached toner is brought back into the hopper by the brush fibers, owing to the fiber flexion at the contact position with the second toner supplying roller. Consequently, since there is no fear that the charged toner once scraped off is reattached to the developing roller by the brush fibers of the first toner supplying roller, even though the developing roller is rotated with very small toner consumption, the thickness of the toner layer formed on the developing roller does not increase, and therefore the density of the image can be kept constant. Furthermore, ghost image removal and the development roller initialization can be further improved. Moreover, since the non-charged toner transported between the first toner supplying roller and the second toner supplying roller is transported through the space between the brush fibers on the surface of the first toner supplying roller, the circulation of the non-charged toner is not obstructed.

Furthermore, in still another developing apparatus according to the present invention, the fiber density of the brush-like member, for instance, the brush fibers formed on (attached to) the surface of the first toner supplying roller is within the range of 5,000 to 15,000 pieces/cm$^2$. For instance, assuming that the density of the brush fibers formed on the surface of the first toner supplying roller is not larger than 5,000 pieces/cm$^2$, unevenness occurs in the amount of scraping off the charged toner from the developing roller, and thereby a problem occurs in initializing the developing roller. The non-charged toner transported into the space between the first toner supplying roller and the second toner supplying roller or into the space between the brush fibers on the surface of the first toner supplying roller flows downward from the gaps of the brush fibers. Consequently, the density of the toner is not raised and therefore sufficient pressure for supplying the toner is maintained.

On the contrary, assuming that the density of the brush fibers formed on the surface of the first toner supplying roller is not smaller than 15,000 pieces/cm$^2$, the toner density of the non-charged toner transported into the space between the first toner supplying roller and the second toner supplying roller or into the space between the brush fibers on the surface of the first toner supplying roller becomes too high. For instance, the toner infiltrating into the space between the brush fibers on the surface of the first toner supplying roller tends to cause problems such as blocking, etc. Consequently, by setting the density of the brush fibers formed on the surface of the first toner supplying roller to a value in the range of 5,000 to 15,000 pieces/cm$^2$, the supplying pressure of the toner can be uniformly created over the entire length of the developing roller and the charged toner on the developing roller can be scraped off.

Furthermore, in still another embodiment according to the present invention, the thickness (diameter per piece) of each of the brush-like members, for instance, the brush fibers formed on the surface of the first toner supplying roller, is in the range of 10 to 60 μm and the length of each of the brush fibers is in the range of 2 to 8 mm. For instance, when the thickness of the brush fibers formed on the surface of the first toner supplying roller is not larger than 10 μm and the length thereof is not larger than 2 mm, the mechanical force of the brush fibers for scraping off the charged toner from the developing roller, and thereby the removal of the developed ghost image on the developing roller, cannot be performed preferably. On the contrary, if the thickness of each of the brush fibers formed on the surface of the first toner supplying roller is not smaller than 60 μm, or the length thereof is not smaller than 8 mm, hairs of fibers left for a long time at the contact position of the first toner supplying roller and the developing roller may fall out, weakening the function of scraping off the charged toner from the developing roller.

Consequently, when the thickness of each of the respective brush fibers formed on the surface of the first toner supplying roller is in the range of 10 to 60 μm and the length thereof is in the range of 2 to 8 mm, when the brush fibers of the first toner supplying roller are brought into contact with the developing roller, a preferable pressurizing force occurs due to the resiliency of the brush fibers, and thereby the operation of scraping off the charged toner on the developing roller can be properly performed.

Furthermore, in still another embodiment according to the present invention, the tip end portion of the brush-like members, for instance the brush fibers formed on the surface of the first toner supplying roller, is straight or looped. In particular, when the tip end portion of the brush fiber on the surface of the first toner supplying roller is looped, e.g., by knitting, when the tip end portion thereof is brought into contact with the developing roller and scrapes off the charged toner on the developing roller, the brush fibers take the charged toner into the loop at the tip end portion thereof and scrub the toner in the loop. Consequently, the charged toner on the developing roller can be more effectively scraped off compared with the case of employing brush fibers having a straight tip ends, and thereby the initialization of the developing roller can be better performed.

Furthermore, in still another embodiment according to the present invention, a predetermined DC voltage is applied between the developing roller and the first toner supplying roller. Thereby, it becomes possible to easily remove the charged toner from the surface of the developing roller and draw the charged toner toward the side of the first toner supplying roller.

In particular, in case that the brush-like member, for instance the brush fiber, is formed on the surface of the first toner supplying roller, a medium-resistance-value treatment is carried out for the brush fibers and the charged toner can be preferably scraped off at the contact position by causing the tip end portion of the brush fibers to slightly cut into the developing roller, by setting the voltage so as to scrape off the charged toner on the developing roller brought into contact therewith and thereby easily draw the charged toner toward the brush fibers side. In this manner, the effect of initializing the developing roller can be obtained and there occur no long term problems such as the brush fibers occasionally falling out.

Furthermore, in still another developing apparatus according to the present invention, a predetermined AC voltage is applied between the developing roller and the first toner supplying roller. In this case, the charged toner can be easily removed from the surface of the developing roller and drawn toward the first toner supplying roller by applying the predetermined AC voltage between the developing roller and the first toner supplying roller and thereby forming an AC electric field. In particular, in case the brush-like member, for instance brush fibers, is formed on the surface of the first toner supplying roller, since the charged toner on the developing roller moves reciprocatingly in the very small gap between the brush fibers by forming the AC electric field between the brush fibers treated with the medium-resistance-value processing and the developing roller brought into contact therewith, the removal of the charged toner from the surface of the developing roller and initializing the developing roller may be easily done.

Furthermore, on this occasion, even if the wrong toner charged in an inverse polarity is mixed in the normal toner charged in a correct polarity in the toner layer, both the normal toner and the wrong toner move reciprocatingly. Therefore, the effect of scraping off both toners from the surface of the developing roller does not change. For this reason, the developing roller can be properly initialized.

Figure 3:
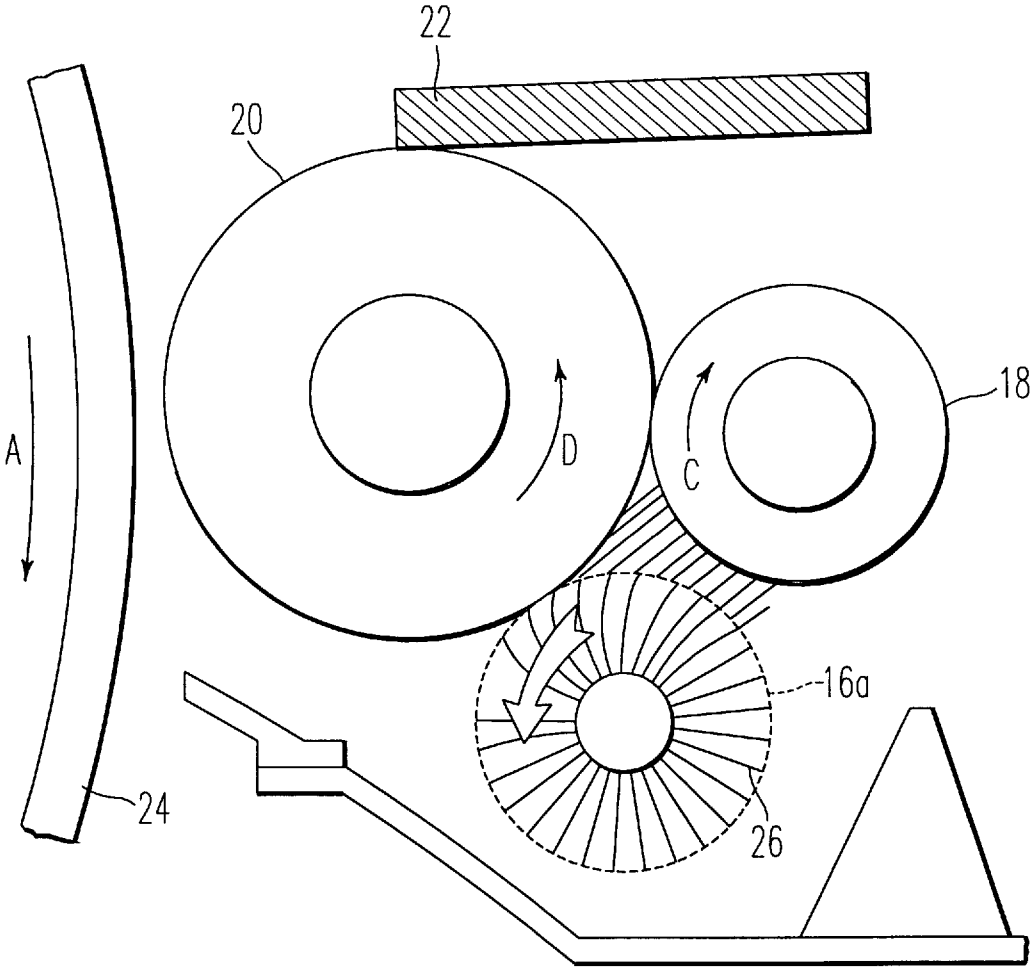
FIG. 3 is an outline cross-sectional view illustrating the toner supplying section in the developing apparatus relating to a first embodiment according to the present invention.

FIG. 3 is an outlined cross-sectional view showing the toner supplying portion of the developing apparatus relating to the first embodiment. Furthermore, FIG. 3 corresponds to the aforementioned FIG. 2, and the same elements as the elements shown in FIG. 2 have the same reference numerals and the explanations thereof are omitted.

The developing apparatus of the first embodiment may instead employ a brush-like toner supplying roller 16*a* having a large number of brush fibers 26 and the surface of the second toner supplying roller 18 may be formed of sponge material, as shown in FIG. 3. In this case, the developing roller 20 is sequentially brought into contact with the brush-like toner supplying roller 16*a* and the second toner supplying roller 18, and a resilient restriction blade 22 is subsequently brought into surface contact with the developing roller 20. Furthermore, a drum-type photosensitive body 24 is opposed to the developing roller 20.

The brush-like toner supplying roller 16a is located at the upstream side of the toner layer forming process after the developing roller 20 passes through the developing area opposed to the photosensitive body 24. As shown by a blank arrow in FIG. 3, the brush-like toner supplying roller 16*a* rotates in an inverse rotational direction to that D of the developing roller 20 at the contact position with the developing roller 20. On the other hand, the second toner supplying roller 18 is located at the downstream side of the toner layer forming process after the developing roller 20 passes the contact position with the brush-like supplying roller 16*a*. As shown by an arrow C in FIG. 3, the second toner supplying roller 18 rotates in a same direction as that D of the developing roller 20 at the contact position with the developing roller 20.

In operation of the first embodiment, the photosensitive body 24 rotates clockwise as shown by arrow A in FIG. 3 at a speed of 200 mm/sec, while the developing roller 20 rotates counterclockwise as shown by arrow D in FIG. 3 at a speed of about 210 mm/sec. Consequently, in the developing area where the photosensitive body 24 and the developing roller 20 oppose each other, both rotate in the same direction.

After development is finished, the developing roller 20 is brought into contact with the brush-like toner supplying roller 16*a*, at which time the tip end portions of the brush fibers 26 scrape off the charged toner attached to the surface of the developing roller 20. Furthermore, the non-charged toner is supplied to the developing roller 20 through the area between the brush-like toner supplying roller 16*a* and the second toner supplying roller 18, that is, the area shown by the hatched lines in FIG. 3.

On the other hand, the second toner supplying roller 18 rotates in the same direction C as that D of the developing roller 20 at the contact position therewith while keeping contact with the developing roller, and supplies the non-charged toner to the developing roller 20 via the hatched area. Furthermore, the second toner supplying roller 18 optimizes the frictional charging and attaching amount of the toner on the developing roller 20 at the contact position with the developing roller 20. Since the second toner supplying roller 18 is made of the sponge material and a large number of brush fibers 26 are formed on the surface of the brush-like toner supplying roller 16*a*, the non-charged toner can be effectively transported to and accumulated in the area between the rollers 16*a* and 18 by the actions of the counterclockwise rotation of the brush-like toner supplying roller 16*a* and the clockwise rotation of the second toner supplying roller 18.

However, when the density of the toner in the above-mentioned area exceeds a predetermined density, the toner escapes from between the brush fibers 26 of the brush-like toner supplying roller 16*a*. Consequently, the blocking phenomenon in which an excessive amount of toner 12 is jammed in the space between the brush-like toner supplying roller 16*a* and the second toner supplying roller 18, and thereby the toner cannot move, does not occur in this embodiment. Furthermore, the toner supplying pressure for supplying the non-charged toner to the developing roller 20 by the second toner supplying roller 18 is always kept constant, and thereby the image can be formed stably for a long period. Moreover, when toner consumption is higher at one side in the longitudinal direction of the developing roller 20, the toner layer can be formed uniformly over the entire length of the developing roller 20 after the toner passes through the toner supplying area, and the development of a ghost image does not appear.

Figure 4:
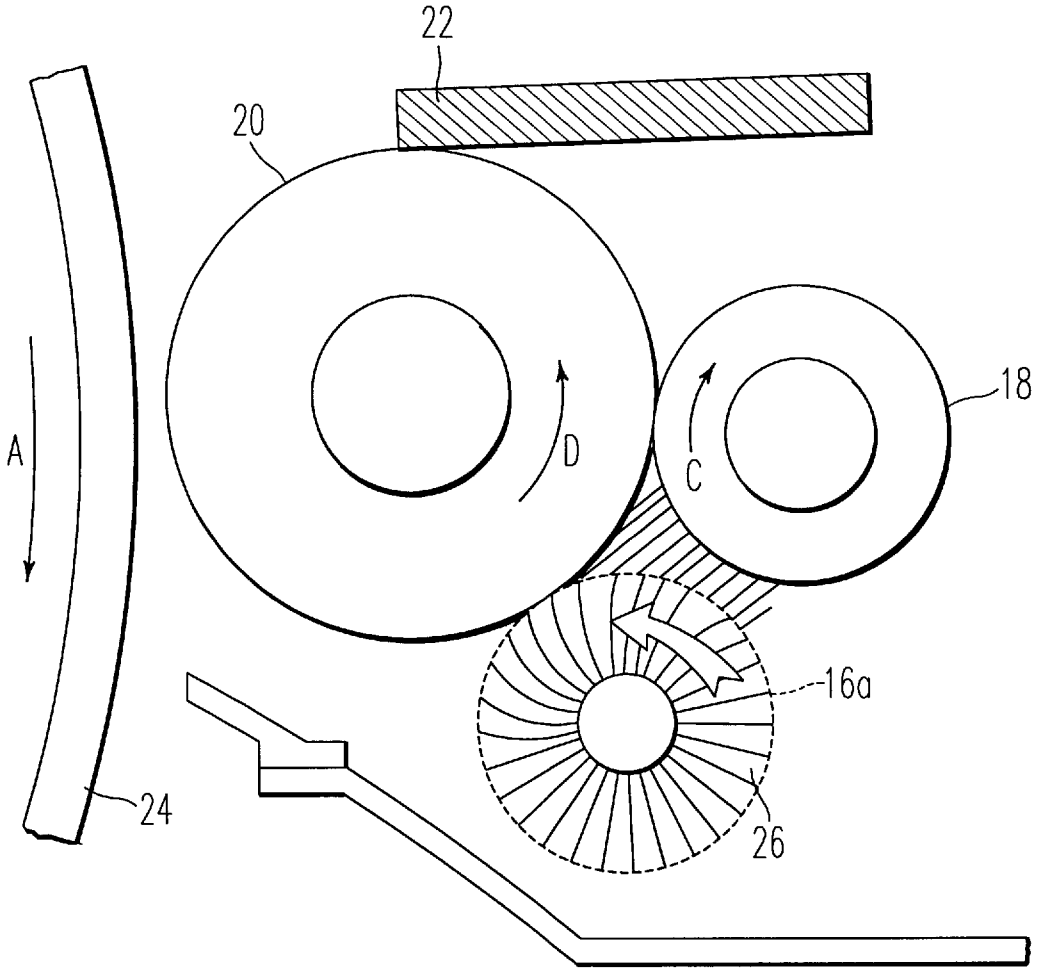
FIG. 4 is an outlined cross-sectional view illustrating the toner supplying section in the developing apparatus relating to a second embodiment according to the present invention.

FIG. 4 is an outlined cross-sectional view showing the toner supplying portion of the developing apparatus of the second embodiment. FIG. 4 corresponds to the FIG. 3, and the same elements as in FIG. 3 have the same reference numerals, and so explanations thereof are omitted.

In the developing apparatus of the second embodiment, the brush-like toner supplying roller 16*a* is brought into contact with the second toner supplying roller 18. Namely, the brush-like toner supplying roller 16*a* having brush fibers 26 formed on the surface thereof and the second toner supplying roller 18 formed with sponge material are brought into contact with each other and installed vertically. Furthermore, the developing roller 20 contacts both the brush-like toner supplying roller 16*a* and the second toner supplying roller 18, and the resilient restriction blade 22 contacts the developing roller 20. Furthermore, the photosensitive body 24 is opposed to the developing roller 20.

In operation of the second embodiment, as in the first embodiment, the photosensitive body 24 rotates clockwise as shown by an arrow A in FIG. 4 at the speed of 200 mm/sec, while the developing roller 20 rotates counterclockwise as shown by an arrow D in FIG. 4 at a speed of about 210 mm/sec. Furthermore, the brush-like toner supplying roller 16*a* rotates in an inverse rotational direction to that D of the developing roller 20 at the contact position with the developing roller 20 as shown by a blank arrow in FIG. 4, and the second toner supplying roller 18 rotates in the same rotational direction as that D of the developing roller 20 at the contact position while in contact with the developing roller 20, as shown by an arrow C in FIG. 4.

The brush-like toner supplying roller 16*a* and the second toner supplying roller 18 are then brought into contact with each other, and both rollers rotate in the same direction at the contact position therebetween. For this reason, there exists no area for transporting and accumulating the non-charged toner between the brush-like toner supplying roller 16*a* and the second toner supplying roller 18, as in FIG. 3, and therefore the toner passes through the spaces between the brush fibers 26 on the surface of the brush-like toner supplying roller 16*a*. Consequently, the amount of transported non-charged toner is controlled by the respective rotational speeds of the brush-like toner supplying roller 16*a*, the second toner supplying roller 18 and the density of the brush fibers 26. Namely, the amount of the toner supplied to the developing roller 20 can be controlled precisely.

Furthermore, even though the charged toner scraped off from the developing roller 20 by the brush fibers 26 of the brush-like toner supplying roller 16*a* is attached to the brush fibers 26, the attached toner separates from the brush fibers 26 by flexion at the contact position with the next second toner supplying roller 18. For this reason, there is no fear that the charged toner scraped off once will again become attached to the developing roller 20 by the brush fibers 26 of the brush-like toner supplying roller 16*a*. Consequently, even in case that the area of the image is small and the amount of the toner consumption is very small, there is no fear that the amount of supply of toner to the developing roller 20 is larger than needed, and thereby the image density can be kept always constant. Furthermore, it is possible to further improve the effect of removing the developed ghost image and the effect of initializing the developing roller 20.

The brush-like toner supplying roller 16*a* as shown in FIG. 3 and FIG. 4 is constructed as follows:

Material of the brush fibers 26 formed on the surface of the roller—polyester fiber.

Shape of the brush fibers 26—straight hair shape.

Length of the brush fibers 26—3 mm.

Thickness of the brush fibers 26 (diameter per one piece) 40 $\mu$m.

Density of the brush fiber 26—8,000 pieces/cm$^2$.

Diameter of the roller—13 mm.

Amount of cutting into the developing roller—0.8 mm.

Line (straight) velocity ratio of the brush-like toner supplying roller 16*a*—0.5. (Here, the rotational direction of the brush-like toner supplying roller 16*a* is inverse to that of the developing roller 20 at the contact position with the developing roller 20.)

Figure 5:
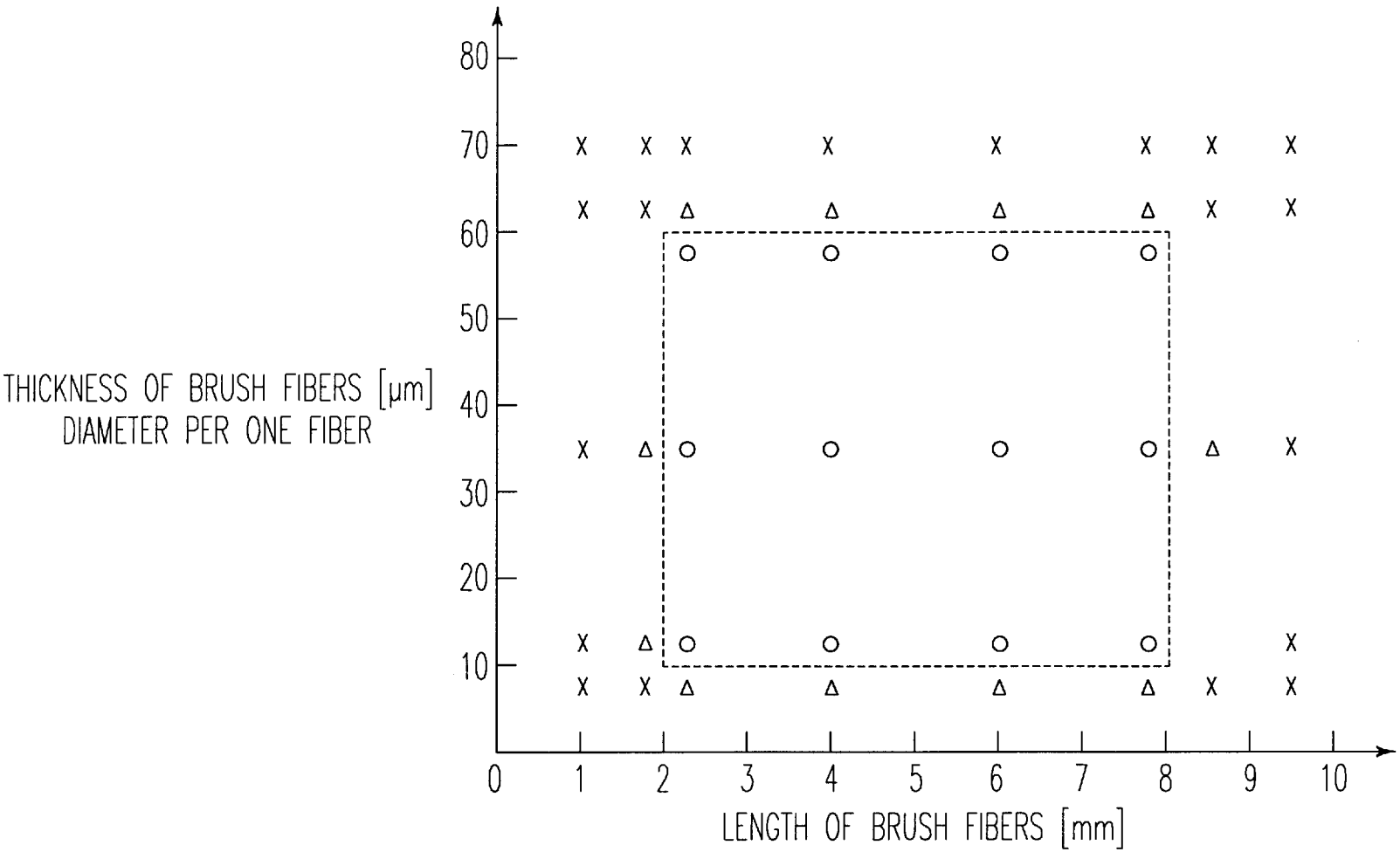
FIG. 5 is a graph showing the quality of the toner supplying and the initialization of the developing roller for variations of length and thickness of the brush fiber of the brush-like toner supplying roller of the first embodiment according to the present invention.

Furthermore, changes in the amount of toner supply and the initialization of the developing roller by changing the length and thickness of the brush fibers 26 on the brush-like toner supplying roller 16*a* have been examined and the results are shown by the graph of FIG. 5. In the graph, the symbols "○" represent a greater than conventional supply of the toner and the initialization of the developing roller for the supplied superior toner, the symbols "Δ" represent the supply of the toner of same quality as that of the conventional device and the initialization of the developing roller for the supplied same-quality toner, and the symbols "X" represent the supply of the toner inferior to the conventional device and the initialization of the developing roller for the supplied inferior toner.

As is apparent from the experimental result shown in FIG. 5, in order to obtain a superior supply of the toner and initialization of the developing roller, the length of the brush fibers 26 on the brush-like toner supplying roller 16*a* should be in the range of 2 to 8 mm. For instance, a length of 3 mm is very preferable. Furthermore, the thickness of the brush fibers 26 should be in the range of 10 $\mu$m to 60 $\mu$m. For instance, the thickness of 40 $\mu$m is very preferable.

Furthermore, an experiment was performed in which the density of the brush fibers 26 on the brush-like toner supplying roller 16*a* was 3,000 pieces/cm$^2$, as a result of which the image became fainter in the area where the toner was consumed on the developing roller 20 after one rotation, while the image became darker in the other area where the toner was not consumed, and further a developed ghost image appeared. Furthermore, when the experiment was performed in which the density of the brush fibers 26 on the brush-like toner supplying roller 16*a* was 20,000 pieces/cm$^2$, after forming images on about 1,000 sheets, the toner jammed in the space between the brush fibers 26 became hardened. In such a blocking state, it was impossible to supply toner.

Assuming that the density of the brush fiber 26 is in the range of 5,000 to 15,000 pieces/cm$^2$, preferably 8,000 pieces/cm$^2$, such problems do not occur and it is possible to efficiently supply toner and initialize the developing roller.

The second toner supplying roller 18 as shown in FIG. 3 and FIG. 4 is constructed as follows:

Material of the roller surface—polyurethane sponge including kneaded carbon.

Thickness of the sponge—3 mm.

Diameter of the roller—13 mm.

Amount of cutting into the developing roller—1 mm.

Line (straight) velocity ratio of the brush-like toner supplying roller 16*a*—0.8.

(Here, the rotational direction of the second toner supplying roller 18 is same as that of the developing roller 20 on the contact position with the developing roller 20.)

Figure 6A:
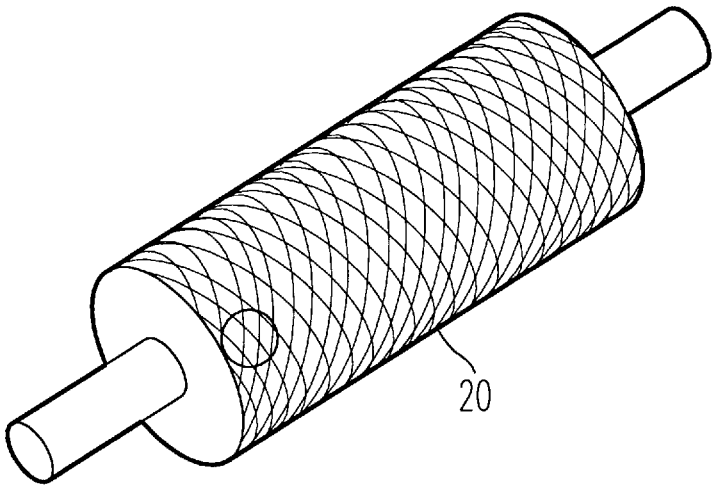
FIG. 6*a* is a perspective view showing the external appearance of the developing roller relating to the first embodiment according to the present invention.
Figure 6B:
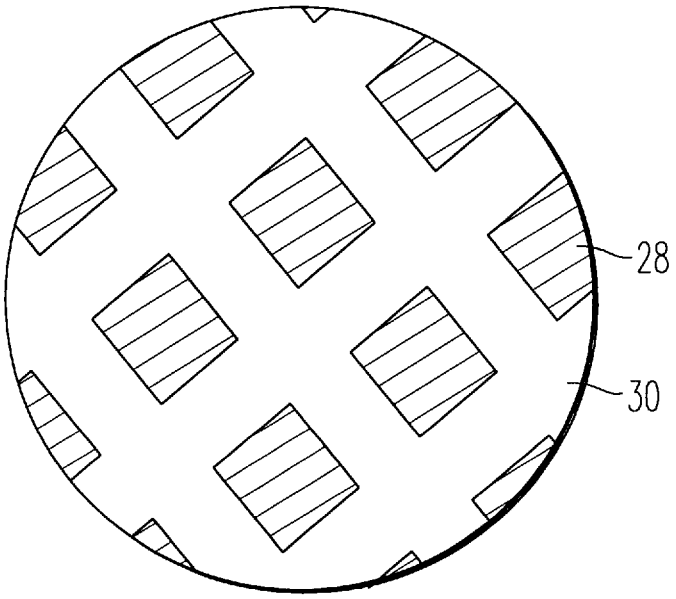
FIG. 6*b* is a partially enlarged view showing the surface of the developing roller shown in FIG. 6*a;*

The developing roller 20 shown in FIG. 3 and FIG. 4 may be constructed as shown in FIGS. 6*a* and 6*b*. FIG. 6*a* is a perspective view showing the external appearance of the developing roller 20, and FIG. 6*b* is a partially enlarged view of the surface of the developing roller 20 of FIG. 6*a*. Namely, the developing roller 20 is a knurl type roller of roller diameter 20 mm having an aluminum core, and conductive surfaces and dielectric surfaces are regularly distributed at a ratio of 3:7 on the surface of the roller.

In a method of making the developing roller 20 shown in FIGS. 6*a* and 6*b*, a twilled diagonal-cloth knurl process is performed on the aluminum core of the developing roller 20. Namely, a groove of 0.1 mm depth and 0.2 mm width is formed on the aluminum core, for instance with a pitch of 0.3 mm and an angle of 45°. Following this process, a dielectric layer coating is performed on the surface thereof Namely, an epoxy property-changed silicone resin is coated and dried at a temperature 50° C. for about 90 minutes. Thereafter, the roller surface processed with the dielectric layer coating is planed by shaving, and thereby the conductive surface 28 composed of aluminum and the dielectric surface 30 composed of epoxy property changed silicone resin are both exposed at the rate of 3:7. As the above silicone resin, for instance, Toray SR2115 (TM) is employed. In such a way, the developing roller 20 shown in FIGS. 6*a* and 6*b* can be made.

Furthermore, the resilient restriction blade 22 shown in FIG. 3 and FIG. 4 is constructed as follows:

Material—urethane rubber.

Thickness—2 mm.

Length of blade to the free end—11 mm.

Amount of blade cutting into the developing roller—0.6 mm.

Amount of projection from the blade contact position to the free end—0.5 mm.

Furthermore, the photosensitive body 24 shown in FIG. 3 and FIG. 4 is constructed as follows:

Sort of photoconductive body—opc.

Electric potential on background surface portion—dc (direct current) voltage −850v.

Electric potential on image portion surface—dc (direct current) voltage −100v.

Furthermore, the developing gap, that is the distance between the developing roller 20 and the opposing photosensitive body 24 is 150 $\mu$m.

The developing bias is DC, −750V.

Furthermore, the toner is constructed as follows:

Minus (negatively)-charged toner employing non-magnetic styrene-acrylic resin average volume−particle diameter—10 $\mu$m.

Externally annexed agent—water-expelling silica fine powder.

The second toner supplying roller 18, the developing roller 20, the resilient restriction blade 22, the photosensitive body 24, developing gap, developing bias, and the toner in the second embodiment are constructed the same as in the above-mentioned first embodiment, except that carbon-kneaded acrylic fiber is employed instead of the polyester fiber used in the above first embodiment, as the material of the brush fibers 26 in the brush-like toner supplying roller 16*a*.

The carbon-kneaded acrylic fiber has the volume resistivity of $10^7$ Ωcm~$10^9$ Ωcm (at the time of applying a voltage of 10V), and the fiber can accept an electric potential difference to the extent of 500V when brought into contact with the conductive developing roller 20. For this reason, assuming that the electric potential of the developing roller 20 is −750V at the time of developing, the electric potential on the roller shaft of the brush-like toner supplying roller 16*a* is set to −550V.

In the above second embodiment, since the charged toner on the developing roller is effectively transferred toward the brush fiber 26 of the brush-like toner supplying roller 16*a*, even though the amount of cutting into the developing roller 20 of the brush fiber 26 is about 0.25 mm, the initializing of the developing roller 20 could be obtained sufficiently. For this reason, compared with the above-mentioned first embodiment, there was no fear of problems such as brush hairs falling out of the brush fibers 26, etc., and the life span of the brush-like toner supplying roller 16*a* was doubled.

The second toner supplying roller 18, the developing roller 20, the resilient restriction blade 22, the photosensitive body 24, developing gap, developing bias, and the toner in a third embodiment are the same as those of the first embodiment, and the brush-like toner supplying roller 16*a* is the same as that of the second embodiment. At this time, the electric potential of the developing roller 20 is −750V, while a superposed electric potential of −750V DC bias and 500 VP-P AC bias is applied to the roller shaft of the brush-like toner supplying roller 16*a*.

In the third embodiment, even though inverse-polarity wrong toner exists in the developing apparatus and appears on the developing roller 20, such inverse-polarity wrong toner can be removed from the developing roller 20 in the same way as can normal-polarity toner by the action of the AC bias applied to the brush-like toner supplying roller 16*a*. For this reason, even though the ratio of the inverse-polarity toner gradually increases when toner is supplemented to the hopper of the developing apparatus, the effect of initializing the developing roller with the brush-like toner supplying roller 16a does not change at all and the state of its initialization can be kept constant.

Figure 7:
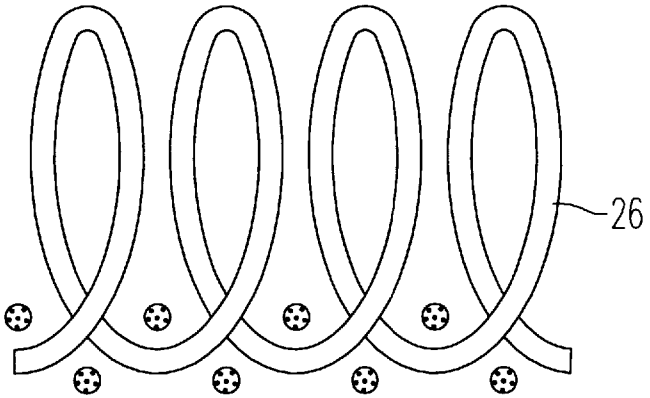
FIG. 7 is an outlined view showing the shape of the brush fiber of the brush-like toner supplying roller relating to still another embodiment according to the present invention.
Figure 8:
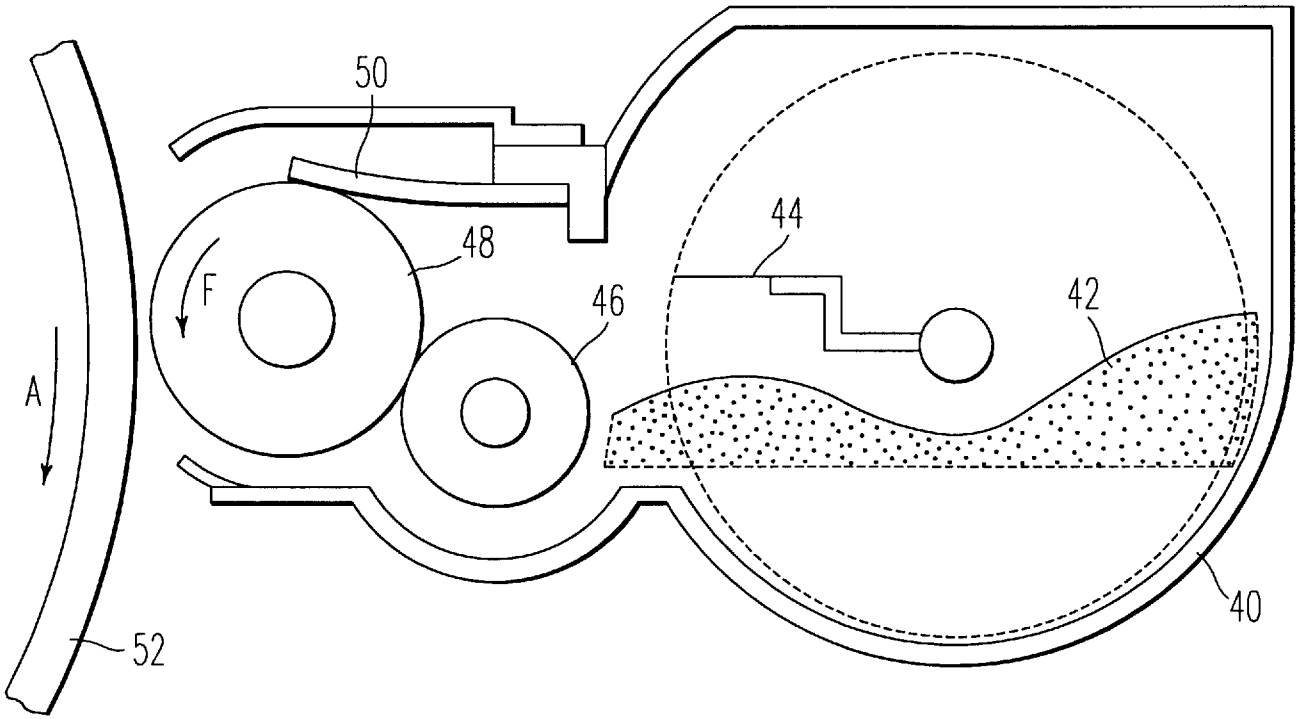
FIG. 8 PRIOR ART
FIG. 8 is an outlined cross-sectional view for explaining the conventional non-magnetic one-component developing apparatus.
Figure 9:
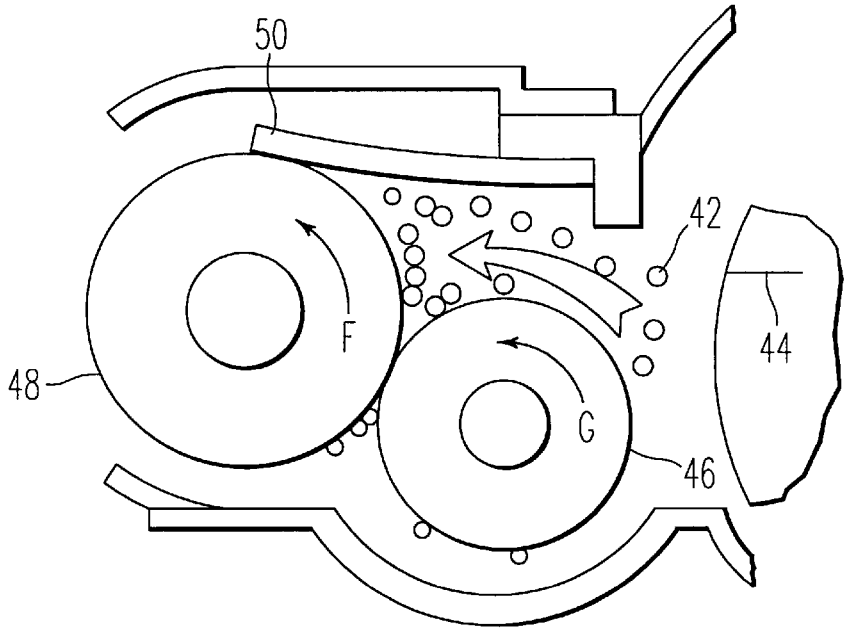
FIG. 9 PRIOR ART
FIG. 9 is a partially enlarged view showing one version of the toner supplying portion of the developing apparatus as shown in FIG. 8.
Figure 10:
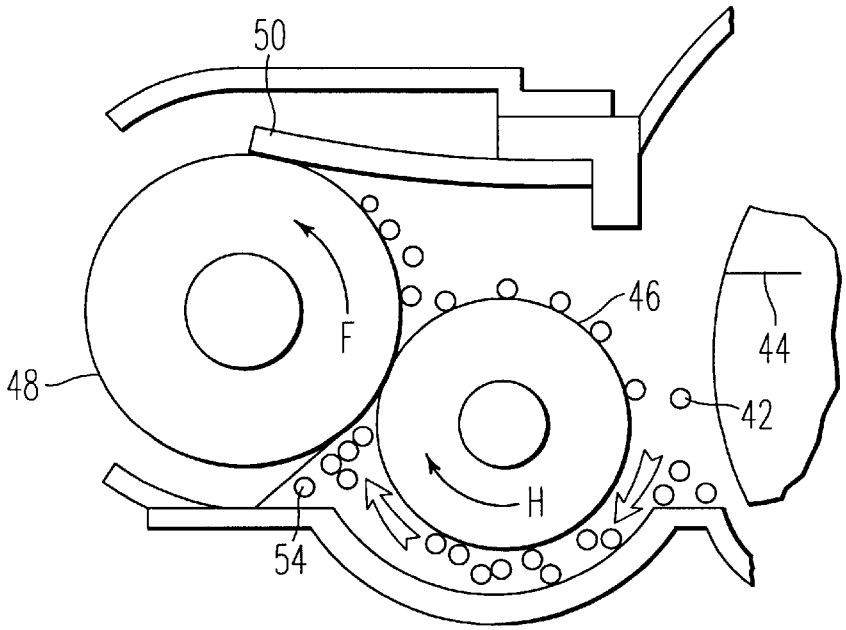
FIG. 10 PRIOR ART
FIG. 10 is a partially enlarged view showing another version of the toner supplying portion of the developing apparatus as shown in FIG. 8.

The second toner supplying roller 18, the developing roller 20, the resilient restriction blade 22, the photosensitive body 24, developing gap, developing bias, and the toner in a fourth embodiment are the same as those of the first embodiment. In the brush-like toner supplying roller 16*a* of this embodiment, the brush fibers 26 are knitted in a loop at their tip end portions, as shown in FIG. 7, instead of the straight-hair brush of the first embodiment.

On this occasion, even though the amount of cutting into the developing roller 20 by the brush fibers 26 is less than the 0.8 mm in the case of the straight-hair brush of the first embodiment, e.g., may be 0.4 mm, the same effects of scraping off the toner and initializing the developing roller could be obtained as in the case of the straight-hair brush type first embodiment (amount of cutting in: 0.8 mm). For this reason, compared with the first embodiment, there is no fear that problems such as fiber fall out of the hair brush may happen in the brush fiber 26 having the looped tip end, and thereby the toner supply and the developing roller initialization can be performed for a long time period.

As explained in detail heretofore, according to the present invention, the following advantageous functional effects can be obtained. Namely, according to the first embodiment, the first developer supplying roller is first brought into contact with the developer carrying roller after the latter roller passes through the developing area and the second developer supplying roller is brought into contact with the developer carrying roller after the developer carrying roller passes through the contact position with the first developer supplying roller. The first developer supplying roller rotates in the inverse rotational direction to that of the developer carrying roller at the contact position therewith, and the second developer supplying roller rotates in the same rotational direction as that of the developer carrying roller at the contact position therewith. Thereby, an always constant amount of the developer is optimumly transported and accumulated between the first developer supplying roller and the second developer supplying roller. Consequently, since the developer can be uniformly supplied onto the developer carrying roller, it is possible to provide a simple developing apparatus capable of preventing variations of the image density before and after the developing operation.

Further, according to the second embodiment, in the first embodiment, a brush-like member is formed on the surface of the first developer supplying roller. The tip end portion of the brush-like member is brought into contact with the developer carrying roller. Thereby, when the developer pressure of the developer between the first developer supplying roller and the second developer supplying roller is raised to a pressure larger than a predetermined value, the developer escapes through the gaps between the brush-like members on the surface of the first developer supplying roller and so the developer pressure can be kept always constant. Consequently, in addition to the effect of the first embodiment, the developer always circulates preferably, and the developer supplying pressure can be made uniform over the entire length of the developer carrying roller. Consequently, a stable attached developer layer can be formed on the developer carrying roller.

Furthermore, according to the third embodiment, in the second developing apparatus, the tip end portion of the brush-like member formed on the surface of the first developer supplying roller is also brought into contact with the second developer supplying roller. Thereby, even though the charged developer scraped off from the developer carrying roller due to the contact with the developer carrying roller is attached to the brush-like member, there is no fear that the attached developer is separated from the brush-like member due to flexion at the contact position with the second developer supplying roller, and is thereafter reattached to the developer carrying roller. Therefore, even though the developer carrying roller is rotated while the developer is not consumed (scarcely consumed), the image density can be kept constant and the effects of removing the developed ghost image and initializing the developer carrying roller can be further improved. Consequently, it is possible to provide a developing apparatus in which the thickness of the developer layer does not change in accordance with consumption of the developer.

Furthermore, according to the fourth embodiment, in the second or third embodiment, when the density of the brush-like member formed on the surface of the first developer supplying roller is in the range of 5,000 to 15,000 pieces/$cm^2$, the pressure for supplying the developer can be uniformly created over the entire length of the developer carrying roller, and the charged developer on the developer carrying roller can be preferably scraped off. Consequently, it is possible to stably perform the developer supply and the removal of the developed ghost image.

Furthermore, according to the fifth embodiment, in the second or third embodiment, the thickness of each of the brush-like members formed on the surface of the first developer supplying roller is in the range of 10 to 60 $\mu$m and the length of each of the brush-like members is in the range of 2 to 8 mm. In such a structure, when the brush-like member of the first developer supplying roller is brought into contact with the developer carrying roller, a preferable pressurizing force can be created by the action of the resiliency of the brush-like member, and thereby the charged developer on the developer carrying roller can be scraped off preferably. Consequently, it is possible to stably perform the developer supply and the removal of the developed ghost image.

Furthermore, according to the sixth embodiment, in the second or third embodiment, the tip end portion of the brush-like member formed on the surface of the first developer supplying roller is knitted to form a loop, and thereby the charged developer on the developer carrying roller can be scraped off more effectively compared with a straight hair brush at the tip end of the brush-like member.

Furthermore, according to a seventh embodiment, in any of the first through sixth embodiments, a predetermined DC voltage is applied between the developer carrying roller and the first developer supplying roller, and thereby the charged developer can be easily scraped off from the developer carrying roller and (easily) drawn toward the side of the first developer supplying roller. In particular, in case the brush-like member is formed on the surface of the first developer supplying roller, the charged developer can be preferably scraped off with the tip end portion of the brush-like member slightly cutting into the developer carrying roller. Consequently, there is no fear that problems of the first developer supplying roller may occur, and the life span can be extended by effectively using the parts of the first developer supplying roller.

Furthermore, according to the eighth embodiment, in any of the first through seventh embodiments, a predetermined AC voltage is applied between the developer carrying roller and the first developer supplying roller, and thereby, even though the wrong developer charged in inverse polarity is mixed in the normal developer charged correctly (in designated polarity) in the developer layer, the charged developer can be easily scraped off from the developer carrying roller and drawn toward the side of the first developer supplying roller. Consequently, the developer carrying roller can be initialized regardless of the time-elapsing state of developer deterioration.

What is claimed as new and is desired to be secured by Letters Patent of the United States is:

1. A developing apparatus for carrying developer on a developer carrying roller and converting a latent image formed on a latent image carrying body to visible image in a developing area by use of the developer, comprising:

a first developer supplying roller contacting the developer carrying roller at a first contact position downstream from the developing area developing area relative to a direction of rotation of the developer carrying roller; and a second developer supplying roller contacting the developer carrying roller at a second contact position downstream from the first contact position relative to the direction of rotation of the developer carrying roller, wherein said first developer supplying roller rotates in a rotational direction such that the direction of movement of said first developer supplying roller is inverse to that of said developer carrying roller at the first contact position, and wherein said second developer supplying roller rotates in a rotational direction such that the direction of movement of said second developer supplying roller is the same as that of said developer carrying roller at the second contact position.

2. The developing apparatus of claim 1 wherein said first developer supplying roller has brush-like members formed on the surface thereof, wherein tip end portions of said brush-like members are brought into contact with said developer carrying roller at said first contact position.

3. The developing apparatus as defined in claim 2, wherein the tip end portions of said brush-like members formed on the surface of said first developer supplying roller are brought into contact with said second developer supplying roller.

4. The developing apparatus as defined in claim 2, wherein the density of said brush-like members formed on the surface of said first developer supplying roller is in the range of 5,000 pieces/$cm^2$ through 15,000 pieces/$cm^2$.

5. The developing apparatus as defined in claim 3, wherein the density of said brush-like members formed on the surface of said first developer supplying roller is in the range of 5,000 pieces/$cm^2$ through 15,000 pieces/$cm^2$.

6. The developing apparatus as defined in claim 2, wherein the respective diameters of said brush-like members formed on the surface of said first developer supplying roller are in the range of 10 $\mu$m through 60 $\mu$m, and the respective lengths thereof are in the range of 2 mm through 8 mm.

7. The developing apparatus as defined in claim 3, wherein the respective diameters of said brush-like members formed on the surface of said first developer supplying roller are in the range of 10 $\mu$m through 60 $\mu$m, and the respective lengths thereof are in the range of 2 mm through 8 mm.

8. The developing apparatus as defined in claim 2, wherein the tip end portions of said brush-like members formed on the surface of said first developer supplying roller are straight.

9. The developing apparatus as defined in claim 3, wherein the tip end portions of said brush-like members formed on the surface of said first developer supplying roller are straight.

10. The developing apparatus as defined in claim 2, wherein the tip end portions of said brush-like members formed on the surface of said first developer supplying roller are looped.

11. The developing apparatus as defined in claim 3, wherein the tip end portions of said brush-like members formed on the surface of said first developer supplying roller are looped.

12. The developing apparatus as defined in claim 1, wherein a predetermined DC voltage is applied between said developer carrying roller and said first developer supplying roller.

13. The developing apparatus as defined in claim 11, wherein a predetermined DC voltage is applied between said developer carrying roller and said first developer supplying roller.

14. The developing apparatus as defined claim 1, wherein a predetermined AC voltage is applied between said developer carrying roller and said first developer supplying roller.

15. The developing apparatus as defined claim 13, wherein a predetermined AC voltage is applied between said developer carrying roller and said first developer supplying roller.

* * * * *